United States Patent [19]

Nakano et al.

[11] 4,146,448

[45] Mar. 27, 1979

[54] PROTECTION OF A STERN TUBE SHAFT LINER

[75] Inventors: Ichiji Nakano, Kure; Youji Kurose, Hiroshima; Fumiki Ogami, Kure, all of Japan

[73] Assignee: Kobe Steel, Limited, Kobe, Japan

[21] Appl. No.: 842,263

[22] Filed: Oct. 14, 1977

Related U.S. Application Data

[63] Continuation of Ser. No. 577,153, May 14, 1975, abandoned.

[30] Foreign Application Priority Data

Jul. 31, 1974 [JP] Japan ..... 49-87738

[51] Int. Cl.[2] ..... C23F 13/00

[52] U.S. Cl. ..... 204/148; 204/197

[58] Field of Search ..... 204/148, 147, 197, 196

[56] References Cited

U.S. PATENT DOCUMENTS

| | | | |
|---|---|---|---|
| 921,641 | 5/1909 | Cumberland | 204/196 |
| 2,067,839 | 1/1937 | Godfrey | 204/197 |
| 3,169,504 | 2/1965 | Gruber | 115/0.5 |
| 3,240,180 | 3/1966 | Byrd | 204/196 |
| 3,726,779 | 4/1973 | Morgan | 204/197 |

OTHER PUBLICATIONS

News of the Month, Motor Ship Publication.

*Primary Examiner*—T. Tung

*Attorney, Agent, or Firm*—Olbon, Fisher, Spivak, McClelland & Maier

[57] ABSTRACT

A method for the electrical protection of a liner used for sealing the stern tube shaft of a ship using an oil bath system, is characterized in that on the sea water-exposed side of the flange portion of the liner proper, at least one easily replaceable sacrificial anode block member is mounted in a circumferential form on the flange portion.

3 Claims, 6 Drawing Figures

PROTECTION OF A STERN TUBE SHAFT LINER

This is a continuation of application Ser. No. 577,153, filed May 14, 1975, now abandoned.

BACKGROUND OF THE INVENTION

1. Field of the Invention

This invention relates to a method for the electrical protection of a liner used for sealing the stern tube shaft of a ship.

2. Description of the Prior Art

Heretofore, a so-called oil bath system such as the one shown in FIG. 1, has frequently been used as a stern tube shaft seal device. In this shaft seal device, the forward side end face of a boss of a propeller 2 mounted on a propeller shaft 1 is connected to the flange face of a liner 3 fitted to the propeller shaft 1 by means of bolts. A plurality of sealing rings 7 fixed by a casing including a cover ring 4, intermediate rings 5 and a flange ring 6 are slidably fitted to the outer periphery of the liner 3 in order to seal the shaft. This shaft seal device is included to prevent intrusion of sea water into the ship and is a very important feature for safe navigation. Using this device, since the liner is always in sliding contact with the sealing rings during navigation, it is necessary for the liner to have excellent wear resistance and excellent corrosion resistance to sea water. Accordingly, a high chromium stainless steel is frequently used as the liner-constituting material.

Since the stainless steel which is used as the liner-constituting material inherently has a good corrosion resistance, no anti-corrosive treatment has been necessary in the past.

However, because of the fairly recent increase in pollution of sea water, even stainless steel liners presently have a tendency to suffer such corrosion phenomena as gap corrosion and porous corrosion. Furthermore, this corrosion is continually increasing in severity. In practice, these forms of corrosion occur in that portion of the liner having sliding contact with the sealing rings on the sea water side. Difficulties such as oil leakage and damage to the sealing ring rubber frequently result.

Accordingly, when such corrosion occurs on a liner, it must be disassembled from the propeller shaft and reprocessed. If the corrosion is extreme, a fresh liner must be mounted and the corroded liner is discarded. In view of the docking cost required by the exchange or refurbishment of liners and the cost of the maintenance itself, a great economic loss is suffered. Hence, it would be most desirable to develop an effective method for protection of liners from corrosion in sea water.

In order to electrically protect the shell of a hull or steel sheet pipes from corrosion, a galvanic anode method has been generally used successfully in the past. In the technique protection is accomplished by using sacrificial anodes made of aluminum and/or zinc. Typical of such devices are those disclosed by the following references: U.S. Pat. No. 3,623,968 (Bohne) which discloses an easily installable sacrificial anode of cylindrical or tubular form to be applied at the joints of welded sections of underground coated pipe to which it is electrically connected; U.S. Pat. No. 3,274,085 to Rutemitter et al; which discloses a consumable aluminum galvanic anodes for cathodic protection of ship ballast tanks among other things; DT-OS 1,446,351 to Maurin et al; which discloses a corrosion protection device for metallic surfaces arranged beneath the earth or submerged in water; and DT-PS 1,133,962 to Determann which discloses the corrosion protection of all submerged parts of the stern of a ship. Other patents related in subject matter are: U.S. Pat. No. 3,562,124 to Leon et al; U.S. Pat. No. 3,616,419 to Bagnulo; U.S. Pat. No. 3,721,618 to Reding et al; U.S. Pat. No. 3,723,282 to Pashak; U.S. Pat. No. 3,864,234 to Wasson; and DT-OS 2,012,864 to Meisel-Krone. However, such devices have not been used in the past in conjunction with stern tube sealing liners.

SUMMARY OF THE INVENTION

Accordingly, it is a primary object of this invention to provide a method for protecting a liner used to seal a stern tube from corrosion.

It is another object of this invention to provide a method for the electrical protection of a liner used for stern tube sealing in which all necessary periodic replacements can be performed easily.

Briefly, these and other objects of the invention as will hereinafter be made clear from the ensuing discussion have been attained by providing a method for the electrical protection of a liner used for the sealing of the stern tube shaft of a ship employing the oil bath system which is characterized in that on the sea water-exposed side of the flange portion of the liner proper, at least one sacrificial anode block member is mounted in a circumferential form on the flange portion in a manner such that it is easily replaceable.

In accordance with other embodiments of this invention, the liner proper is electrically insulated from the propeller and/or the anode block member consists of at least one material selected from aluminum, aluminum alloys, zinc and zinc alloys.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

In general, the sea water-exposed side of a liner used for stern tube sealing has an area of about $1m^2$ even in the case of a super-large tanker. Thus, the area to be protected is very small. In view of the required protection potential only, the quantity of the sacrificial anode composed of zinc, aluminum or the like may be small. However, since the liner is composed of stainless steel, it is necessary to apply a higher protection current than is used in the case of protection of ordinary hull shells or other iron materials. Accordingly, in order to extend anode lifetime, large anodes should be attached.

Figure 2:
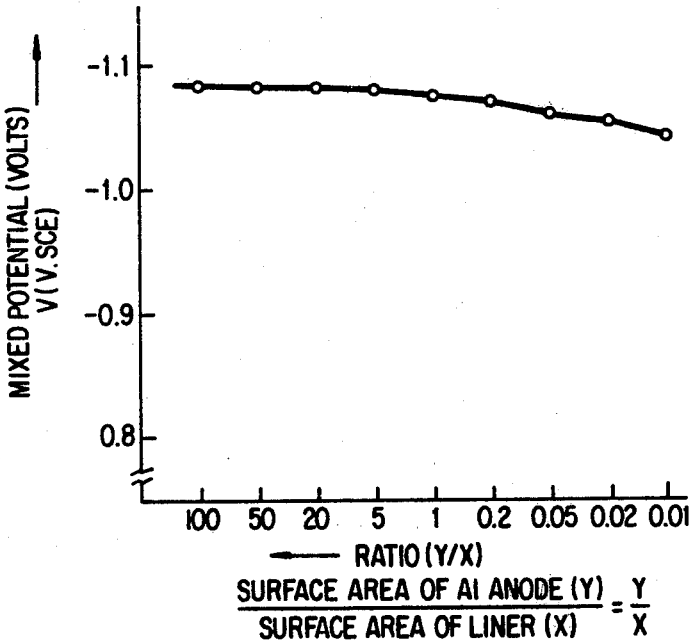
FIG. 2 is a graph illustrating the relationship between the ratio of the sea water-exposed surface area of the aluminum anode to the sea water-exposed surface area of the liner member and the mixed potential observed when this invention is used in static sea water.
Figure 3:
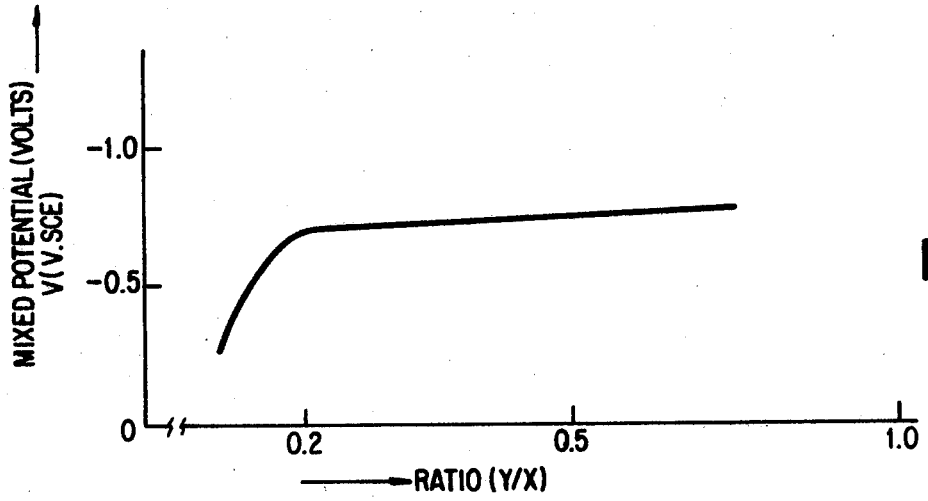
FIG. 3 is a graph illustrating the same relation as illustrated in FIG. 2 in the case of flowing sea water.
Figure 4:
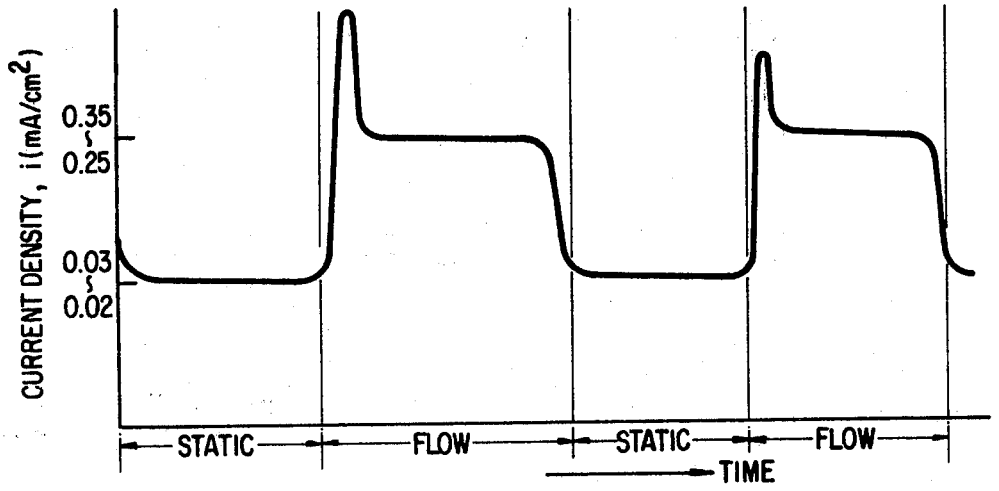
FIG. 4 is a graph showing the change in the protecting current density between the liner member and the aluminum sacrificial anode at an area ratio of 20% in either static sea water or flowing sea water.

FIGS. 2, 3, and 4 contain the results of experiments using the protection device of this invention. More specifically, FIG. 2 illustrates the relationship of the mixed potential relative to the ratio between the sea water-exposed surface area of the aluminum anode to the sea water-exposed surface area of the high chromium stainless steel liner in the case of static sea water. FIG. 3 illustrates the same relation of the mixed potential to the sea water-exposed surface area ratio in flowing sea water. From FIG. 2, it can be seen that the mixed potential in static sea water is substantially anodically dominated throughout the space area ratio range shown in FIG. 2. In flowing sea water, as can be seen from FIG. 3, a cut-off point exists when the area ratio (Y/X) is about 0.2. Below this value, the mixed potential decreases toward zero. Accordingly, when the liner is protected by a sacrificial anode, good protection results can be obtained if the area ratio (Y/X) is not lower than 0.2.

FIG. 4 illustrates the density of the protection current flowing between the liner member (high chromium stainless steel) and the aluminum sacrificial anode at an area ratio (Y/X) of 0.2 in either static sea water or flowing sea water. In the case of static sea water, the current density is from 0.02 to 0.03 $mA/cm^2$; and in the case of flowing sea water, the current density is 0.25 to 0.35 $mA/cm^2$. Therefore, the necessary anode weight can be calculated from the protection current density in flowing sea water according to the following formulas:

$$I = 3XS, \text{ and } W = LI/KQ$$

wherein I indicates the average current (A) generated; S is the area of the liner ($m^2$) to be protected; W is the weight of the anode (kg); L denotes the anode lifetime (years), K denotes the replacement coefficient; and Q indicates the effective amount (A · year/kg) of the current generated.

Accordingly, if the anode lifetime, i.e., the term of the periodic inspection, is 4 years, the required amount of aluminum alloy sacrificial anode is 54 kg per $m^2$ of the liner. In the case of aluminum, zinc and zinc alloy sacrificial anodes, the required amount can be similarly calculated.

As is apparent from the foregoing illustration, it is most desirable that a considerable amount of the sacrificial anode should be mounted. In practice, however, in view of the position at which the liner is disposed and the space available for the liner, it is difficult to mount a large quantity of the sacrificial anode on the liner. Furthermore, since it often happens that the casing is shifted to the side of the propeller for repairs or the like, the space between the propeller and the casing cannot be entirely utilized for attachment of an anode. Thus, this invention is also characterized by the manner of attaching this sacrificial anode. Embodiments of this invention will now be illustrated more specfically by reference to FIGS. 5 and 6.

Figure 1:
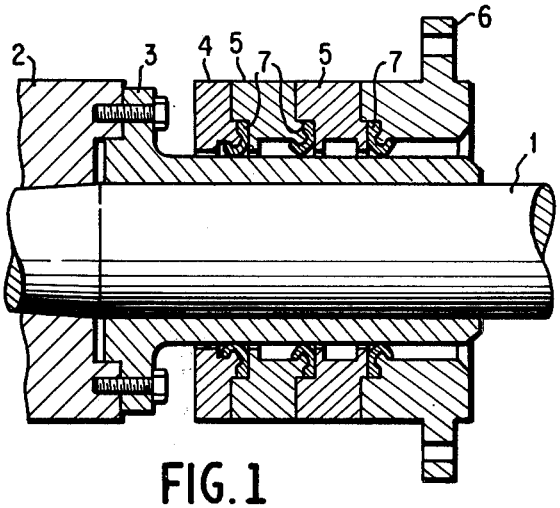
FIG. 1 PRIOR ART
FIG. 1 is a sectional view illustrating the arrangement in a conventional stern tube shaft seal in a device employing the oil bath system.
Figure 5:
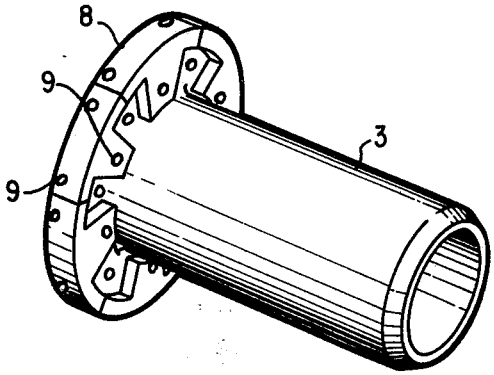
FIG. 5 is a perspective view of a sacrificial anode mounted on the flange portion of the liner proper according to this invention.

Referring to FIG. 5, a plurality of sacrificial anode block members 8 are mounted in a circumferential form on the flange portion 3 of the liner on the sea water-exposed side thereof by means of bolts 9. In this manner, sacrificial anode block members can be effectively disposed.

Figure 6:
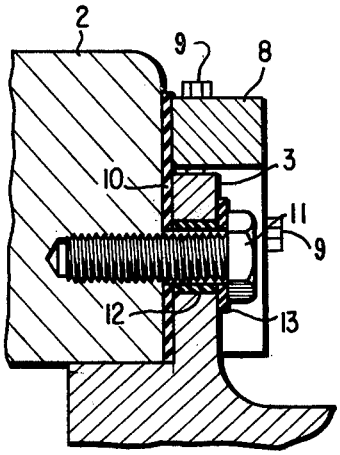
FIG. 6 is a sectional view of a liner, provided with a sacrificial anode, attached to a propeller according to this invention.

In this embodiment, since the sacrificial anodes 8 are connected by means of bolts, their replacement can be accomplished easily. FIG. 6 illustrates the configuration in which a liner 3 having a sacrificial anode mounted on the flange portion is attached to the forward side end face of a boss of a propeller 2. In FIG. 6, a sheet packing 10 is interposed between the forward side end face of the boss of the propeller 2 and the liner flange 3 on which the sacrificial anode 8 is mounted, and an insulating sleeve 12 is inserted into the hole for the bolt 11 for attachment of the liner. The washer 13 is also composed of an insulation material. Accordingly, the liner is completely electrically insulated from the propeller. It is not absolutely necessary that the liner be electrically insulated from the propeller. Even if it is not insulated, some beneficial effects can be attained. However, far superior results are obtained when the liner is insulated from the propeller. When a structure as illustrated above is adopted, only sacrificial anodes are attached directly to the liner. Hence, the corrosion resistance effect is enhanced.

When the above-described protection method is used, corrosion of the liner used for sealing a stern tube shaft can be effectively prevented. Difficulties such as intrusion of sea water into the chamber, oil leakage in the shaft seal device and damage to the sealing ring rubber can also easily be overcome.

Having now fully described the invention, it will be apparent to one of ordinary skill in the art that many changes and modifications can be made thereto without departing from the spirit or scope of the invention as set forth herein.

What is claimed as new and desired to be secured by letters patent of the U.S. is:

1. A method for electrical protection of a tubular liner disposed about a stern tube shaft for sealing the same, wherein said liner has a circumferential flanged portion disposed upon the sea water exposed side thereof, comprising the steps of:

removably securing a plurality of sacrificial anode block members upon said circumferential flanged portion of said liner to form a substantially annular sacrificial anode member such that the ratio of surface area of said anode member to surface area of said liner is not less than 0.2; and electrically insulating the liner proper from a propeller mounted on said stern tube shaft.

2. The method of claim 1 wherein the sacrificial anode block member consists of at least one material selected from the group consisting of aluminum, aluminum alloys, zinc, and zinc alloys.

3. The method of claim 1 wherein the weight of said anode conforms to the formulas:

$$I = 3XS \text{ and } W = LI/KQ$$

wherein I indicates the average current generated;
S is the area of the liner ($m^2$) to be protected;
W is the weight of the anode (kg);
L denotes the anode lifetime in years;
K denotes replacement coefficient; and
Q indicates the effective amount of current generated.

* * * * *